US005546634A

United States Patent [19]

Genevray

[11] Patent Number: 5,546,634

[45] Date of Patent: Aug. 20, 1996

[54] CYLINDER DISTANCE ADJUSTING DEVICE FOR CARDING MACHINE

[75] Inventor: Henri Genevray, Guebwiller, France

[73] Assignee: N. Schlumberger et Cie, S.A., Guebwiller, France

[21] Appl. No.: 246,102

[22] Filed: May 19, 1994

[30] Foreign Application Priority Data

May 19, 1993 [FR] France ..... 93 06275

[51] Int. Cl.[6] ..... D01G 15/18; D01G 15/50

[52] U.S. Cl. ..... 19/101; 19/106 R

[58] Field of Search ..... 19/100, 101, 102, 19/103, 106 R, 106 A, 112, 260, 261

[56] References Cited

U.S. PATENT DOCUMENTS

| | | | |
|---|---|---|---|
| 1,652,215 | 12/1927 | Putnam | 19/100 |
| 3,950,822 | 4/1976 | Bolli | 19/100 |
| 5,065,637 | 11/1991 | Soltermann et al. | 19/106 R X |
| 5,142,741 | 9/1992 | Demuth et al. | 19/102 X |

FOREIGN PATENT DOCUMENTS

| | | | |
|---|---|---|---|
| 561075 | 10/1923 | France . | |
| 4115960 | 11/1992 | Germany . | |
| 1231225 | 10/1986 | Japan | 19/102 |
| 1629362 | 2/1991 | U.S.S.R. | 19/100 |
| 0002450 | 5/1883 | United Kingdom | 19/100 |
| 0018630 | 8/1903 | United Kingdom | 19/100 |
| WO79/00983 | 11/1979 | WIPO . | |

*Primary Examiner*—Ismael Izaguirre
*Attorney, Agent, or Firm*—Young & Thompson

[57] ABSTRACT

Textile machinery comprising a card having a main swift and a member which is a working cylinder or a comb, juxtaposed to the main swift and having a shaft. The distance between the main swift and the shaft is adjustable by providing a support for the shaft, the support being mounted on and for movement relative to a frame of the card. A gauge holder against which the support is adapted to bear, has a plurality of rotated positions in each of which the gauge holder imparts to the support a different position, in each of which different positions the shaft is at a different distance from the main swift. A fluid pressure jack applies the support to the gauge holder. The gauge holder is rotated by a ratchet and pawl assembly actuated by another fluid pressure jack. The gauge holder has a plurality of gauges thereon radiating in different directions therefrom, those gauges being of different lengths and being selectively engageable with the support.

6 Claims, 4 Drawing Sheets

CYLINDER DISTANCE ADJUSTING DEVICE FOR CARDING MACHINE

FIELD OF THE INVENTION

The present invention relates to the field of textile industry, particularly cards, and has for its object a device for the adjustment of the distance between the working cylinders and the main swift and/or between the comb doffer and the main swift of a card.

BACKGROUND OF THE INVENTION

At present, this adjustment is effected manually, the machine being stopped, by proceeding first with unlocking a certain number of screw nuts, then adjusting shims, eccentrics or other adjustment means, and, finally, re-locking and blocking the assembly. This series of operations must be performed on both sides of the card.

This known adjustment process has the drawback of being long and meticulous, because it requires unlocking of numerous screw nuts of large size, an adjustment of the two sides of the machine, re-locking the assembly and adjusting by trial and error, such that the output of the machine is considerably decreased, particularly if the adjustments must be frequently repeated.

Moreover, these adjustments are very large and must be precise, such that their careful performance requires a highly qualified operator, which leads to large costs.

SUMMARY OF THE INVENTION

The present invention has for its object to overcome these drawbacks by proposing to effect this adjustment in an automatic manner, which is to say after display of the desired adjustment or distance, the latter is effected automatically as required.

To this end, the invention has for its object an adjustment device for the distance between the working cylinders and the main swift and/or between the comb doffer and the main swift of a card, characterized in that it is constituted, for each working cylinder and/or for the comb, by a support and mounting means adjustable in position on the machine frame and coacting with a positioning device for telecontrolled adjustment.

BRIEF DESCRIPTION OF THE DRAWINGS

The invention will be better understood from the description which follows, which relates to a preferred embodiment, given by way of nonlimiting example and explained with reference to the accompanying schematic drawings, in which.

DETAILED DESCRIPTION OF THE INVENTION

Figure 1:
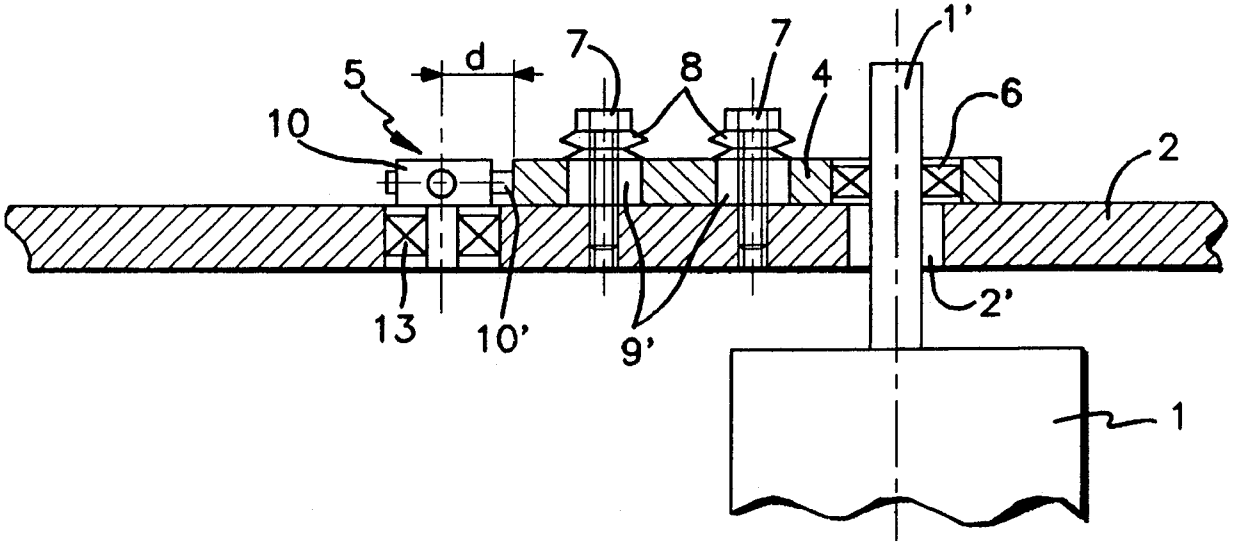
FIG. 1 is a fragmentary plan and cross sectional view of a device according to the invention.
Figure 2:
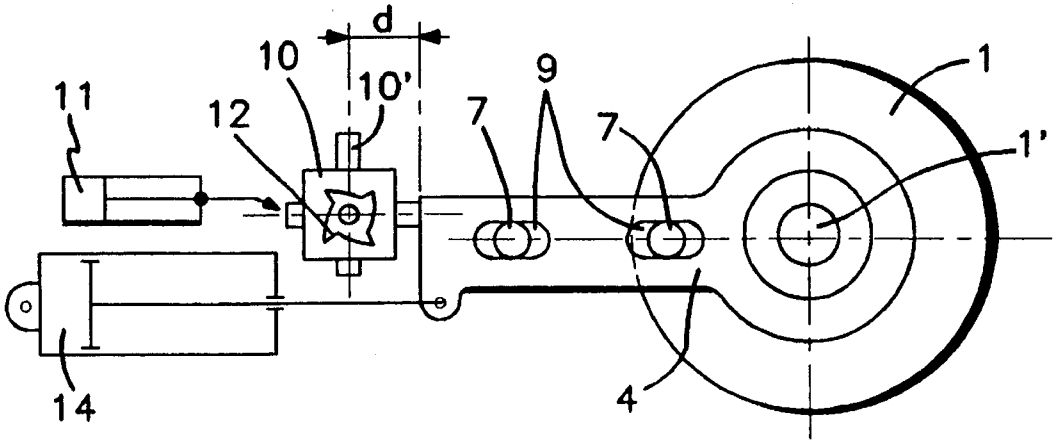
FIG. 2 is a side elevational view of the device according to FIG. 1.

FIGS. 1 and 2 of the accompanying drawing show by way of example a working cylinder 1 or comb doffer mounted on a machine frame 2 by means of a device 3 for adjustment of the distance between said working cylinder 1 and the main swift or between the comb and the main swift.

According to the invention, this device 3 is constituted, for each working cylinder 1 and/or for the comb, by a means 4 for supporting and adjustably mounting in position on the frame 2 of the machine and cooperating with a device 5 for telecontrolled adjustment of position.

According to a characteristic of the invention, the means 4 for supporting and adjustably mounting in position on the frame 2 of the machine is constituted, for each end of the axle 1' of the working cylinder 1, by a plate supporting said end by means of a bearing 6 and fixed on the frame 2 of the machine by means of screw assemblies 7 and stacked resilient washers 8, the screws 7 passing through oblong holes 9 of said plate and the axle 1' passing through an oblong hole 2' of the frame 2.

Such a mounting permits relative locking of the plate forming the means for coacting with one end of the axle 1' of the working cylinder 1, while ensuring the possibility of displacement of said plate along the frame 2. Thus, the elasticity conferred by the stack of resilient washers 8 permits, with a sufficient gripping of the plate forming the means 4 on the frame 2, displacement of said plate on said frame 2, without it being necessary to unlock the screws 7, the oblong holes 9 permitting guidance and displacement.

The device 5 for telecontrolled positioning coacting with the means 4 for supporting and mounting adjustably in position on the frame 2 is preferably constituted by gauge holder 10 mounted with the possibility of rotation by means of an actuator 11 on the frame 2 and coacting with the plate forming the means 4 for supporting the end 1' of the working cylinder 1.

This gauge holder 10 is preferably in the form of a polygonal element provided on each face with a gauge 10' for bearing against the corresponding end of the plate forming the means 4, the different gauges 10' having different lengths.

According to a characteristic of the invention, the actuator 11 is constituted preferably by a jack whose piston rod coacts with a ratchet 12 or the like fixed to the gauge holder 10 by means of its axle of rotation. The gauge holder 10 can be mounted for example on the frame 2 by means of a bearing 13.

Each plate forming the means 4 for supporting and adjustable mounting in position on the frame 2 of the machine is connected to a longitudinal displacement device 14, preferably in the form of a jack (FIG. 2).

Thus, after actuation of the gauge holder 10 into the predetermined position corresponding to the desired adjustment of the working cylinder 10, an actuation of the jack 14 in the direction of the gauge holder 10, against the corresponding gauge 10', will have the effect of automatically effecting said adjustment to the desired position. To this end, the jack 14 is actuated in the first place in a direction opposite that of the gauge holder 10 so as to permit an actuation and rotation of this latter by means of the corresponding actuator or jack 11. Because of the difference in length of the gauges 10' of the gauge holder 10, the distance d between the axis of the gauge holder 10 and the corresponding end of the plate forming the means 4, determines the value of the displacement to a greater or lesser extent of the axle 1' of the cylinder 1 and hence of its spacing from the main swift.

Figure 1A:
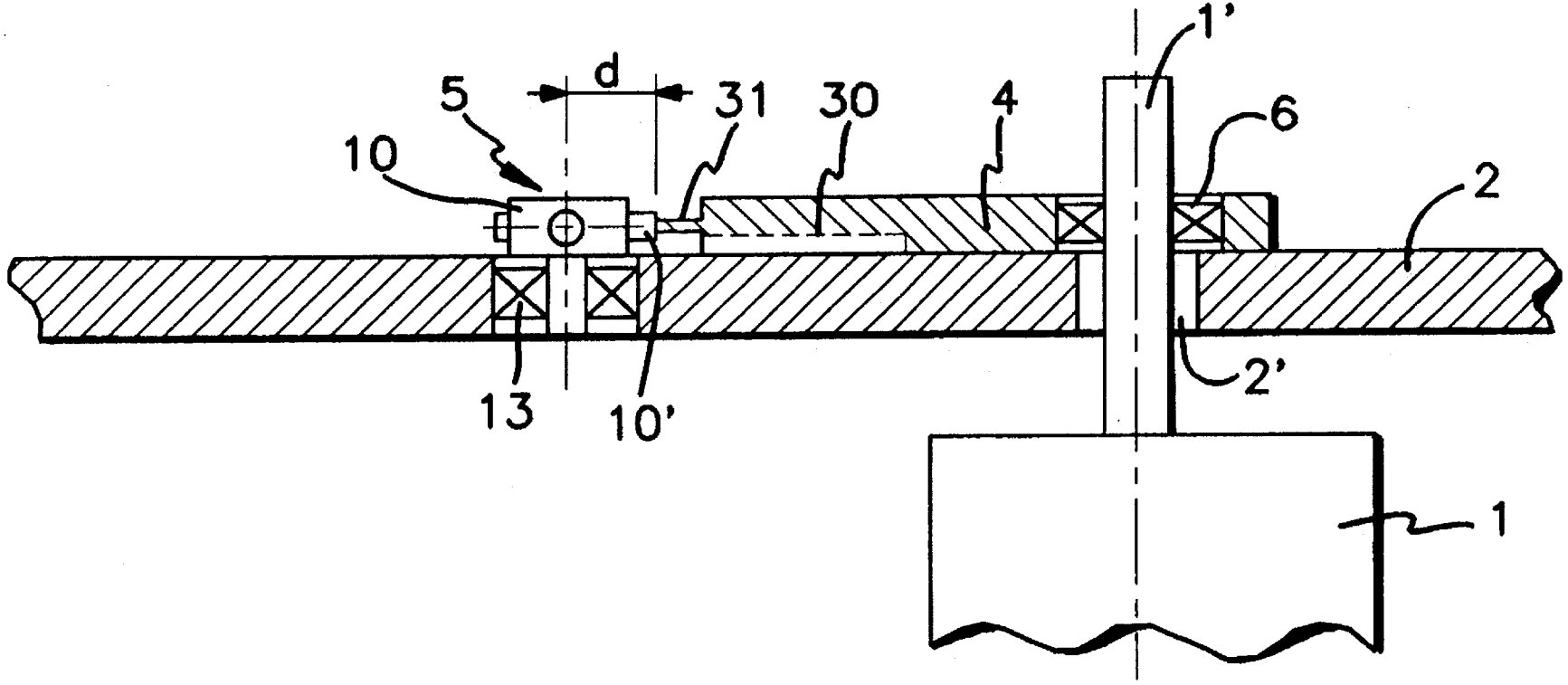
FIG. 1*a* is a fragmentary plan and cross sectional view of a device according to a modification of the invention.

According to a modified embodiment, shown in FIG. 1*a* of the accompanying drawings, for adjusting the comb, the means 4 for supporting and adjustably mounting in position on the frame 2 of the machine is constituted, for each end of the axle of said comb, by a slideway forming a pillow block, guided along a rail 30 of the frame 2 and provided with a rod 31 or the like adapted to coact by its free end with the device 5 for telecontrolled positioning and provided with a connection means to a longitudinal displacement device 14.

In such a case, the adjustment in position is analogous to that described above for a working cylinder.

Figure 3:
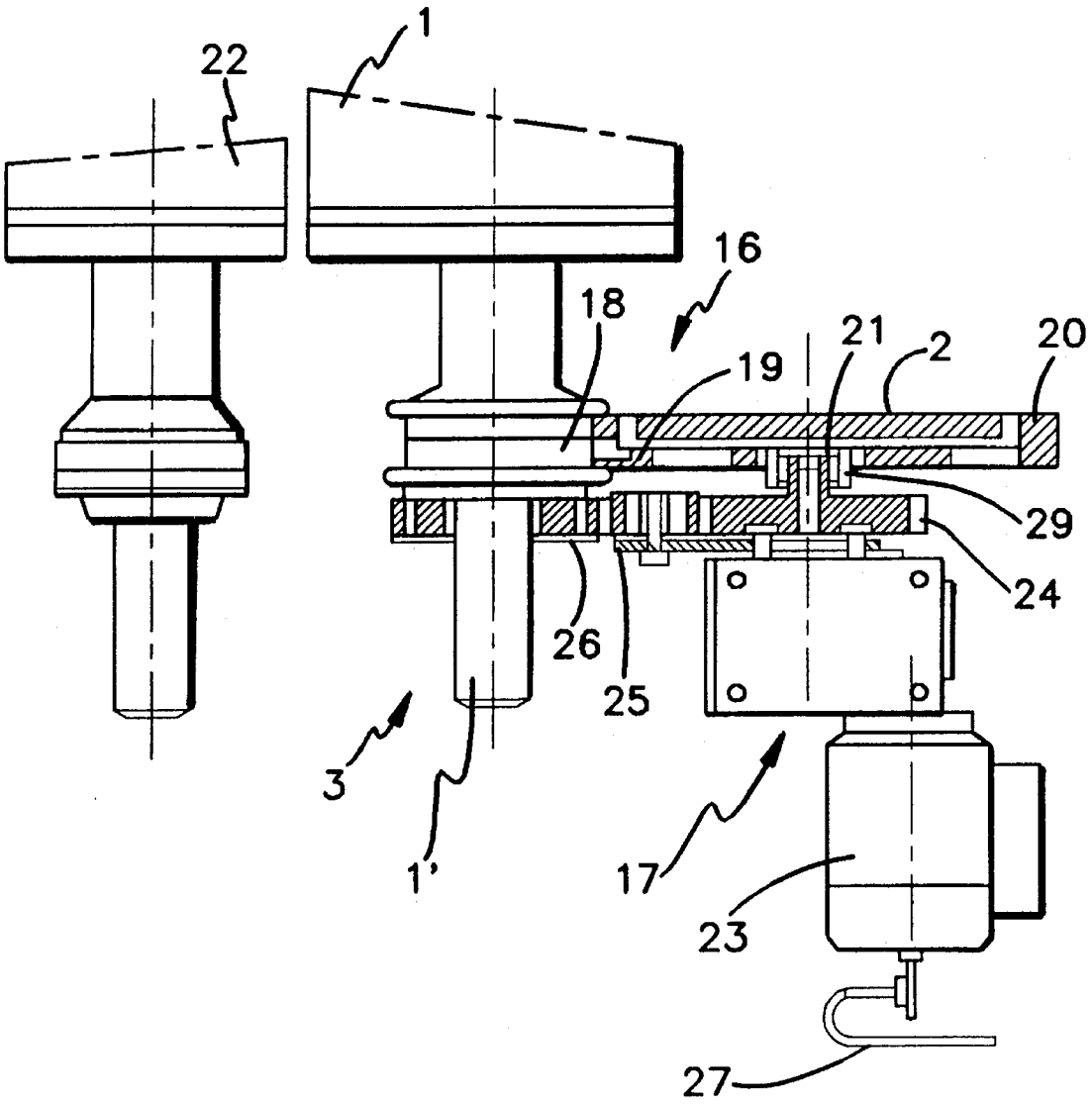
FIG. 3 is a view analogous to that of FIG. 1 of a modification of the invention.
Figure 5:
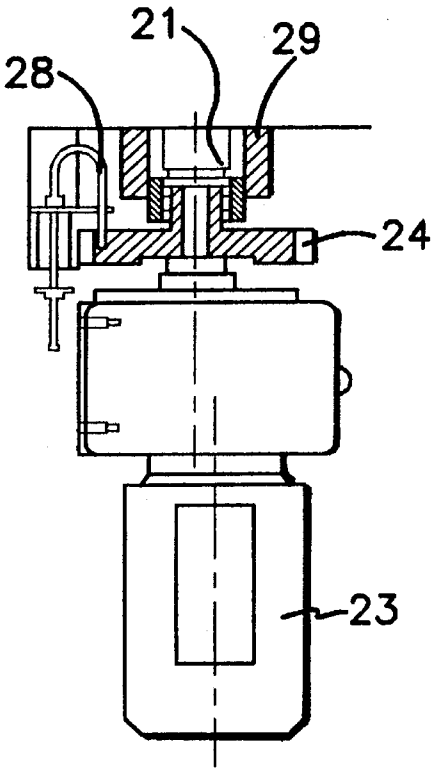
FIG. 5 is a partial plan view on a larger scale showing the initialization detector.
Figure 4:
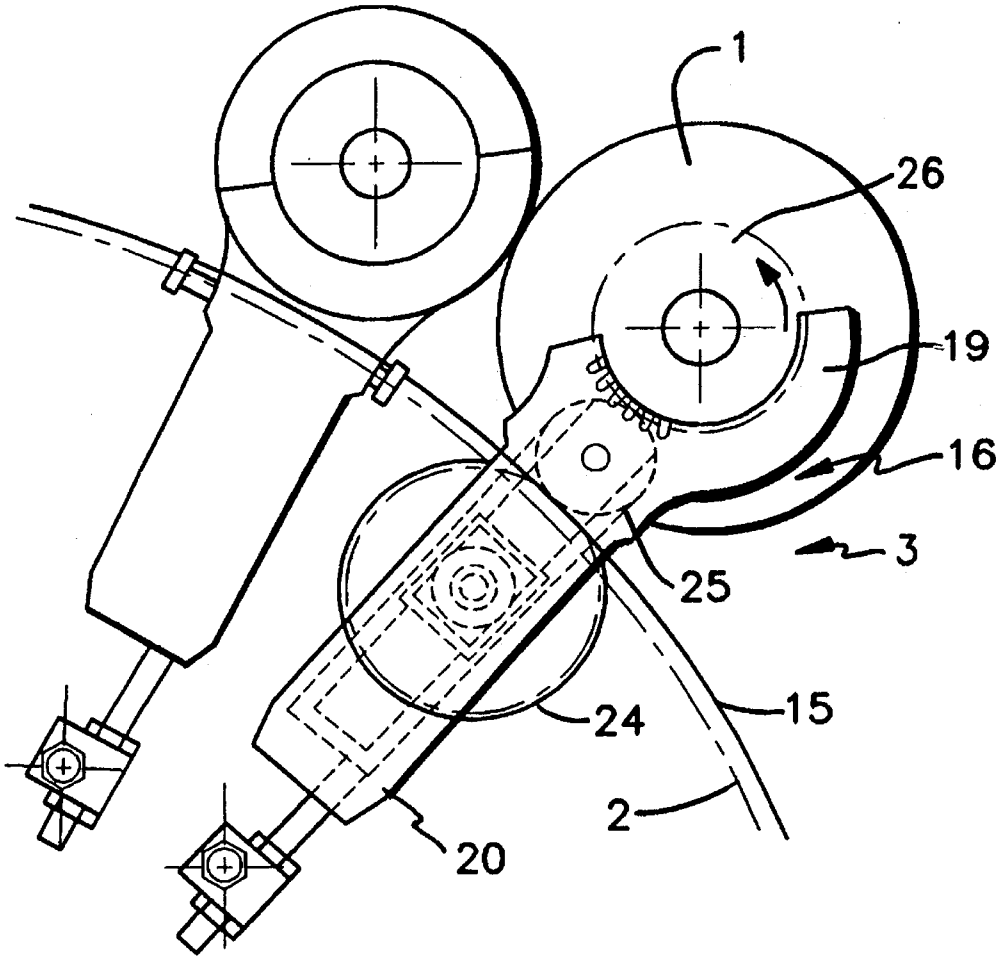
FIG. 4 is a partial side elevational view of the embodiment of FIG. 3.

FIGS. 3–5 of the accompanying drawings show a modified embodiment of the invention, in which the device 3 for adjustment of the distance between the working cylinder 1 or a comb and the main swift 15 is constituted, for each working cylinder 1 and/or for the comb, by means 16 for supporting and mounting adjustably in position on the frame 2 of the machine, radially with respect to the axis of said main swift 15 and actuated by a device 17 for control and monitoring.

The means 16 for supporting and mounting, adjustable in position on the frame 2 of the machine, radially with respect to the axis of the main swift 15, is preferably constituted by a first eccentric socket 18 for reception of the axle 1' of the working cylinder 1 or of the comb, mounted in a bearing 19 at the end of a support arm 20 secured to the frame 2 of the machine and by a second eccentric socket 21 controlled by the position of the working cylinder 1 or of the comb relative to the scavenging cylinder 22 and coacting with the frame 2 (FIG. 3).

The device 17 for control and monitoring is constituted by a motoreducer assembly 23 acting, by means of a pinion 24 engaging with an intermediate pinion 25, on a pinion 26 secured to the first eccentric socket 18 for reception of the axle 1' of the working cylinder 1 or of the comb, the pinion 24 being secured moreover to the second eccentric socket 21 coacting with a guide 29 provided on the frame 2 (FIG. 3), by a first detector 27 for controlling the position in rotation of the first eccentric socket 18 connected to the shaft of the motoreducer and by a second detector 28 for initialization of the device 17 connected to a counter (not shown) and coacting with the pinion 24 of the motoreducer 23 (FIGS. 3 and 5).

Such a mounting permits, by actuation of the motoreducer 23, driving in rotation the first eccentric socket 18 and the adjustment of the distance between the working cylinder 1 or the comb and the main swift 15, because of the engagement of the pinions 24–26. Because of the initialization of the device by means of the second detector 28, the position in rotation of the first socket 18 can be perfectly controlled.

Moreover, because of the provision of the second socket 21, the position of the support arm 20 is continuously maintained equal with respect to the scavenging cylinder 22.

Thanks to the invention, it is possible to effect adjustments and hence displacements of the heavy pieces automatically by means of actuators such as jacks or the like, such that the manipulation of large pieces and the manual adjustments can be avoided, which leads to considerable saving of time and, because of this, a substantial improvement of the output of the machine.

Moreover, because all the adjustments are powered, it suffices for the operator to program the necessary adjustments, the automatic device executing these operations without the intervention of a highly qualified operator.

Thus, the machine can be used by personnel of lesser qualification, which saves money.

Of course, the invention is not limited to the embodiment described and illustrated in the accompanying drawing. Modifications remain possible, particularly as to the construction of the various elements or by substitution of technical equivalents, without thereby departing from the scope of protection of the invention.

What is claimed is:

1. Device for adjusting the distance between working cylinders and a main swift and/or between a comb and the main swift of a card, the comb and each working cylinder having an axle, said device comprising for each working cylinder and/or for the comb, a supporting and mounting means adjustable in position on a machine frame, a support arm secured to the machine frame, a positioning device including means for telecontrolled adjustment, said positioning device being operatively associated and coacting with said supporting and mounting means, said main swift having an axis, said means for supporting and mounting being adjustable in position on the frame, radially with respect to said axis and including a first eccentric socket for receiving the axle of the working cylinder or of the comb, said first eccentric socket being mounted in a bearing at the end of the support arm, and a second eccentric socket controlled by the position of the working cylinder relative to a scavenging cylinder and coacting with the machine frame.

2. Device according to claim 1, wherein the positioning device for telecontrolled adjustment comprises a motor reducer assembly acting via pinion means on a pinion secured to the first eccentric socket, said pinion means being secured to the second eccentric socket, said second eccentric socket coacting with a guide provided on the machine frame, said motor reducer assembly having a shaft, a first detector connected to the shaft for controlling the position in rotation of the first eccentric socket, and a second detector for initialization of the device, said second detector coacting with said pinion means.

3. Device for adjusting the distance between working cylinders and a main swift and/or between a comb and the main swift of a card, the comb and each working cylinder having an axle, said device comprising for each working cylinder and/or for the comb, a supporting and mounting means adjustable in position on a machine frame, a positioning device including means for telecontrolled adjustment, said supporting and mounting means being connected to a longitudinal displacement device, said positioning device being operatively associated and coacting with said supporting and mounting means, which comprise, for each end of the axle of the working cylinder, a plate supporting said end via a bearing and fixed on the machine frame by screws and stacked resilient washers, said machine frame and said plate having oblong holes, said screws passing through the oblong holes of the plate, said axle passing through an oblong hole of the machine frame, said positioning device comprising a gauge holder mounted for rotation via an actuator on the frame and coacting with the plate supporting the end of the working cylinder, said gauge holder being in the form of a polygonal element having a plurality of faces, each face including a gauge for bearing against the corresponding end of the plate, and each gauge having a different length.

4. Device for adjusting the distance between working cylinders and a main swift and/or between a comb and the main swift of a card, the comb and each working cylinder having an axle, said device comprising for each working cylinder and/or for the comb, a supporting and mounting means adjustable in position on a machine frame, a positioning device including means for telecontrolled adjustment, said supporting and mounting means being connected to a longitudinal displacement device, said positioning device being operatively associated and coacting with said supporting and mounting means, which comprise, for each end of the axle of the working cylinder, a plate supporting said end via a bearing and fixed on the machine frame by screws and stacked resilient washers, said machine frame and said plate having oblong holes, said screws passing through the oblong holes of the plate, said axle passing through an oblong hole of the machine frame, said positioning device comprising a gauge holder mounted for rotation via an actuator on the frame and coacting with the plate supporting the end of the working cylinder, said actuator comprising a jack having a piston rod which coacts with a ratchet having an axle of rotation, and said ratchet being fixed to the gauge holder via the axle of rotation.

5. Device for adjusting the distance between working cylinders and a main swift and/or between a comb and the main swift of a card, the comb and each working cylinder having an axle, said device comprising for each working cylinder and/or for the comb, a supporting and mounting means adjustable in position on a machine frame, a positioning device including means for telecontrolled adjustment, said supporting and mounting means being connected to a jack, and said positioning device being operatively associated and coacting with said supporting and mounting means.

6. Device for adjusting the distance between working cylinders and a main swift and/or between a comb and the main swift of a card, the comb and each working cylinder having an axle, said device comprising for each working cylinder and/or for the comb, a supporting and mounting means adjustable in position on a machine frame having a rail, a positioning device including means for telecontrolled adjustment, said supporting and mounting means being connected to a longitudinal displacement device, said positioning device being operatively associated and coacting with said supporting and mounting means, said means for supporting and adjustably mounting in position on the machine frame, comprising, for each end of the axle of said comb, a slideway forming a pillow block guided along the rail of the frame and provided with a rod having a free end for coacting with the positioning device, and provided with a connection means to said longitudinal displacement device.

* * * * *